US006205747B1

(12) United States Patent
Paniagua Olaechea

(10) Patent No.: US 6,205,747 B1
(45) Date of Patent: Mar. 27, 2001

(54) PROCESS FOR CLOSING NETS FOR FRUITS AND THE LIKE AND NET CLOSED BY MEANS OF SAID PROCESS

(76) Inventor: Rosalina Paniagua Olaechea, Plaza Del Reino 4, 8° 15ª, Alzira(Valencia) (ES), 46600

( * ) Notice: Subject to any disclaimer, the term of this patent is extended or adjusted under 35 U.S.C. 154(b) by 0 days.

(21) Appl. No.: 09/169,921

(22) Filed: Sep. 18, 1998

(51) Int. Cl.[7] ..... B65B 51/00; B65B 51/04
(52) U.S. Cl. ..... 53/417; 53/138.4
(58) Field of Search ..... 53/417, 138.3, 53/138.4, 138.2, 459, 410

(56) References Cited

U.S. PATENT DOCUMENTS

| | | | | |
|---|---|---|---|---|
| 3,348,595 | | 10/1967 | Stevens et al. | 150/3 |
| 3,732,662 | | 5/1973 | Paxton | 53/14 |
| 4,247,005 | * | 1/1981 | Buxton | 53/138.4 |
| 4,446,677 | | 5/1984 | Kokido | 53/577 |
| 4,999,969 | * | 3/1991 | Holmes | 53/138.3 |
| 5,485,711 | * | 1/1996 | Suzuki et al. | 53/417 |
| 5,600,938 | * | 2/1997 | Trimble | 53/417 |
| 6,088,999 | * | 7/2000 | Olaechea | 53/417 |

FOREIGN PATENT DOCUMENTS

| | | |
|---|---|---|
| 23 07 354 | 8/1974 | (DE) . |
| 182465 | 4/1974 | (ES) . |

* cited by examiner

*Primary Examiner*—Brian L. Johnson
*Assistant Examiner*—Matthew Luby
(74) *Attorney, Agent, or Firm*—Darby & Darby

(57) ABSTRACT

The process comprises the welding of the lower extremity of the net, then filling the net with the predetermined amount of fruits or the like, and making a second transversal welding of the tubular net element in an upper area of the net, and nipping the tubular net element in an area comprised between the upper welded closure and the fruits contained in the net, closing the net by means of a dismountable clamp which remains incorporated at a point situated under the upper welded closure of the net and above the net. The net can be opened and closed repetitively.

2 Claims, 4 Drawing Sheets

PROCESS FOR CLOSING NETS FOR FRUITS AND THE LIKE AND NET CLOSED BY MEANS OF SAID PROCESS

DESCRIPTION

The present invention relates to the closure of net bags, especially of the type used for packing fruit and vegetables. It relates also to a net bag which has been closed in accordance with the present process.

BACKGROUND OF THE INVENTION

In net bags known at present for packing fruit and the like, it is conventional to use welding or stapling effected transversely to the tube of continuous net from which the bags are formed in succession. The net tube is fed continuously into the packing machine and the process of closing the bag consists in effecting a first transverse welding or stapling of the tubular element, then filling the bag with the predetermined weight of pieces of fruit and subsequently effecting a further welding or stapling operation in the upper portion, which delimits the bag, and at the same time producing a further upper transverse weld, corresponding to the bottom of the following bag and finally cutting the tubular net element in the region between the two adjacent upper welds or staples.

That process is economical and enables bags that are closed by welding or stapling at both ends to be obtained. However, when the bags are put to practical use by the consumers who purchase them, it is often convenient to use only some of the pieces of fruit contained in the bag. This is difficult because, in the currently known bags, once the closure produced by welding has been destroyed, the bag cannot be closed again and therefore all of its contents have to be removed and placed elsewhere.

BRIEF SUMMARY OF THE INVENTION

The process of the present invention is intended to provide net bags for fruit and the like which are closed by welding or stapling at one end, corresponding to the bottom of the bag, and which are closed at the upper portion by a removable element, thereby providing bags that can be readily opened and closed, enabling only a portion of the contents to be used.

Therefore, the process of the present invention comprises the following successive stages:

a) Feeding the tubular net element into the filling machine or device, leaving the previously cut lower end of the tube free in order to be able to pinch it and weld it.

b) Pinching and welding the tubular element in a region near the cut lower end.

c) Filling the bag with the required amount of fruit or vegetables.

d) Advancing the tubular net element in order to leave free the tubular net region located above the mass of fruit placed inside it.

e) Transverse pinching, welding and closing of the bag by means of a removable closure element.

f) Cutting the tubular net element in the region between the removable closure device and the upper weld.

The bag for fruit and the like produced in accordance with the present invention therefore comprises a tubular net element which is closed by welding or stapling at its lower end and which contains the required amount of pieces of fruit, and the bag is closed at the top by a closure element enabling it to be opened and closed repeatedly, in order to permit use of only a portion of the pieces of fruit or vegetables contained in the bag.

The removable closure elements may be of various types, ranging from strip elements of some rigidity which are fitted onto the net bag and which fasten it by being twisted onto it, to clips produced from plastics or another material having a mouth which pinches and fastens the net bag, being resilient but sufficiently strong to prevent it from being opened inadvertently and nevertheless being able to be attached and detached manually with a small amount of force.

The closure elements may include labels which are provided with the desired written information.

BRIEF DESCRIPTION OF THE DRAWINGS

For a better understanding of the invention, a series of drawings corresponding to the implementation of the process of the present invention and to the bag for fruit and the like obtained by using the process is appended by way of non-limiting example.

FIG. 1 shows a tubular net element 1 in which the first stage of welding or stapling the lower end 2 has been effected by means of a conventional system 3 and the pieces of fruit 4 have been placed inside the tubular net element in the amount predetermined by weighing.

Figure 1:
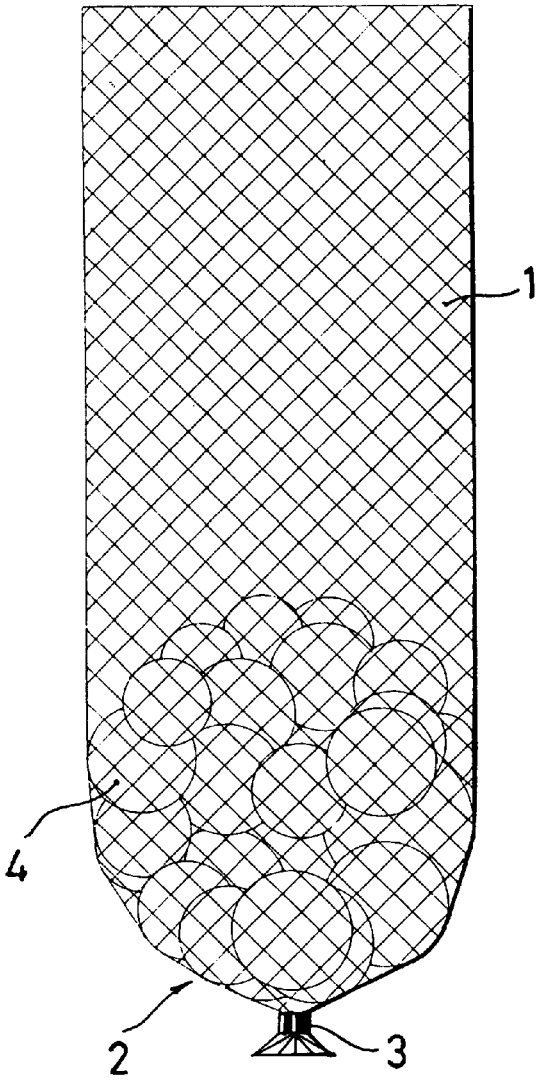
FIGS. 1–4 are front elevational views of a tubular net showing the sequence of steps of the present invention.
Figure 2:
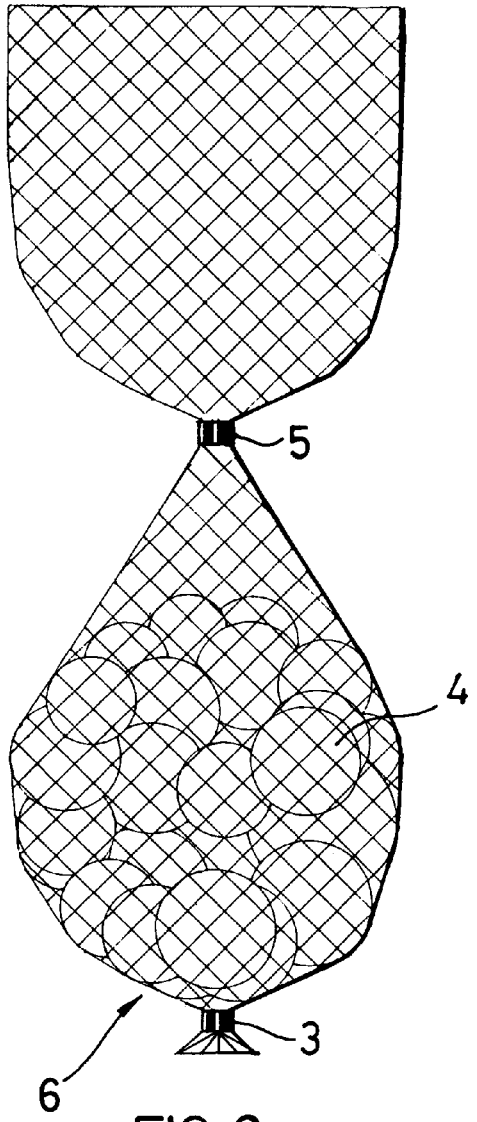

The following stage of the process comprises carrying out a second welding or stapling 5 of the tubular element, above the mass of pieces of fruit contained in the bag, which is thus now defined and has been indicated by the numeral 6.

Subsequently, a removable closure element 7 is arranged below the upper welded or stapled joint 5. The final stage of the process consists in cutting the intermediate region 8 between the removable closure element 7 and the upper weld or staple 5 by means of a blade system conventional in this field, which has been indicated by the numerals 9 and 10.

After that operation, the bag 6 of fruit, formed by a portion of the tubular net element, is complete, the lower end 2 being closed by the weld or staple 3 and the upper end 11 being closed by the removable closure element 7, which can be opened and closed as desired, in order to remove portions of the contents of the bag.

Figure 3:
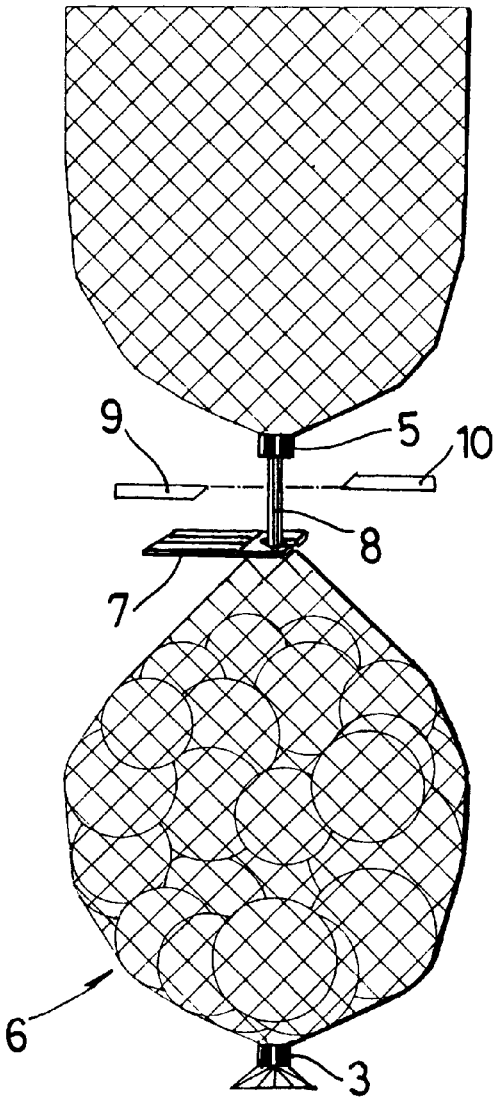
Figure 4:
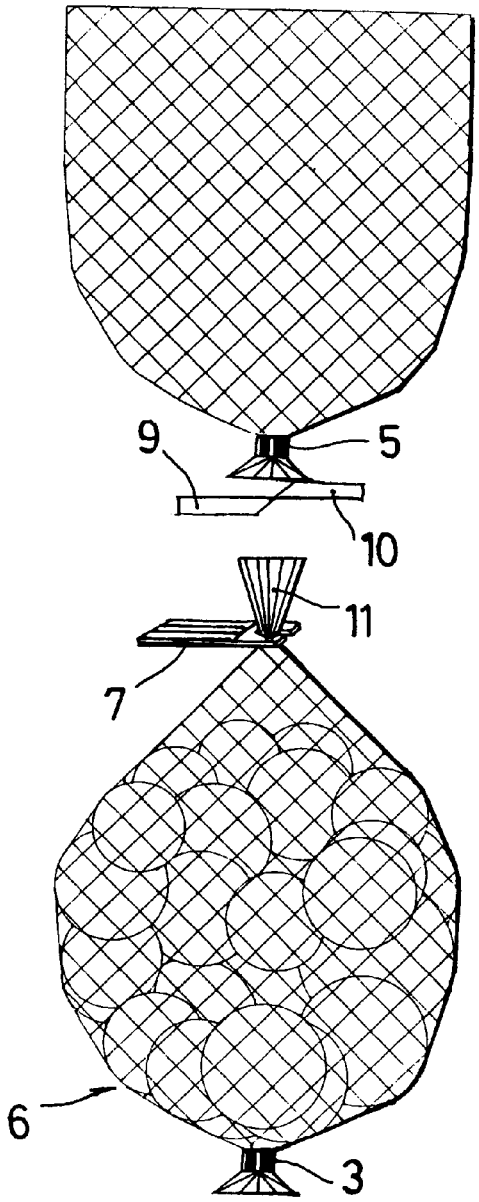
Figure 5:
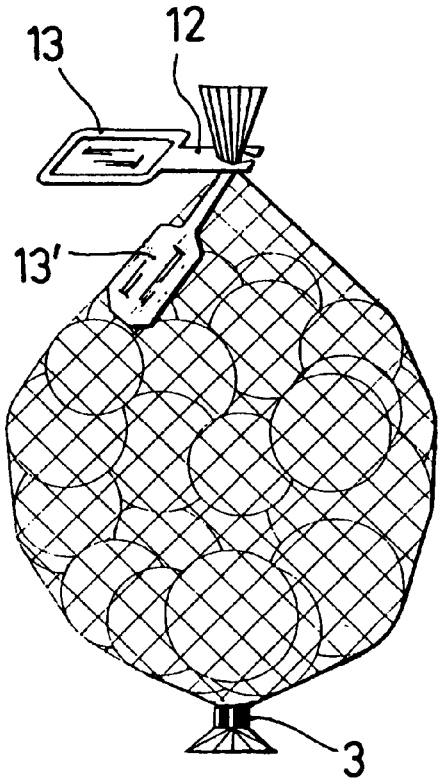
FIG. 5 is a front elevational view of a modified embodiment of a bag with tags attached; and, FIGS. 6–7 are front elevational views of respective modified embodiments with different handles attached.
Figure 6:
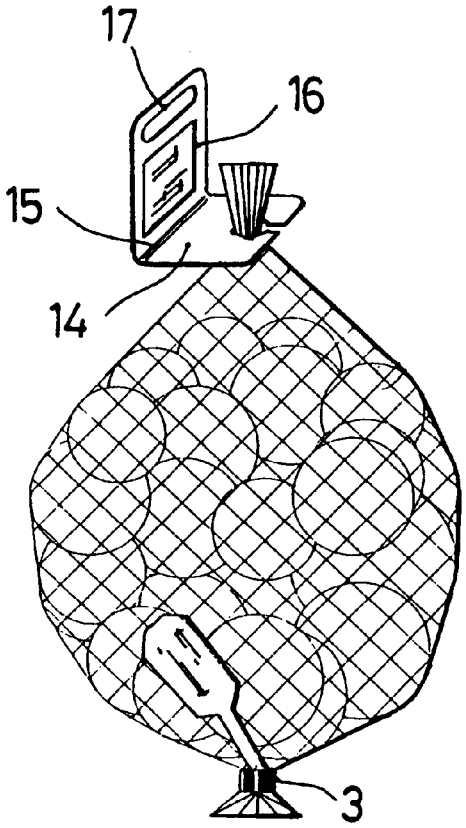

The closure elements are conventional and may be formed, as shown in FIGS. 3 and 4, by a body having an end mouth which can be fitted onto the pinched net tube and which is able to retain the tube to effect a releasable closure, or may be formed, as shown in FIGS. 5 and 6, by a member having a closure clip 12 which is extended by a label 13 in the form of one or two elements, as indicated by the numeral 13' or may be in the form of the version illustrated in FIG. 6, which shows a clip of a substantially rectangular flat type 14 foldable about a line of weakness 15 and having a second flat region 16 which may have a handle 17 for carrying the bag.

Figure 7:
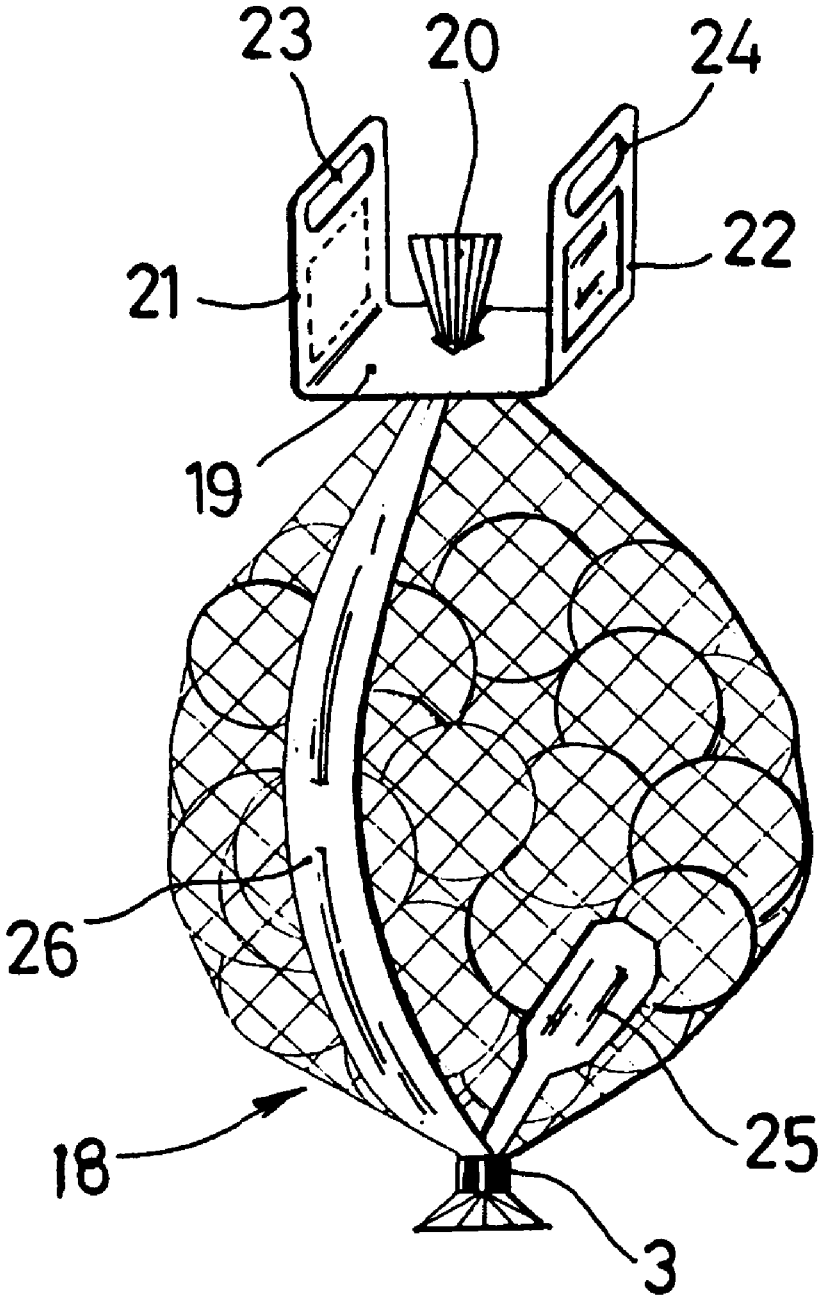

In the case represented in FIG. 7, the bag 18 has an upper closure element in the form of a flat strip 19 having a central region, through which the end 20 of the bag passes, and lateral wings 21 and 22 provided with openings 23 and 24 acting as handles. In this case, the bag may carry an additional label 25 at the lower end closed by welding and a band 26 for connecting the upper end to the lower end.

At all events it will be appreciated that the precise form of the removable closure may vary widely without departing from the scope of the present invention.

What is claimed is:

1. A method for closing bags comprising a tubular net element that is fed continuously to a filling station including the steps of:

welding closed the lower end of the net element to form a net bag;

filling the bag with a preselected amount of the product to be bagged;

providing a second weld on said net element at a location spaced above the product;

pinching together said net element in the region between said second weld and the product;

attaching a reusable closure element to the pinched region of said net element between said second weld and the product, for alternately opening and closing said bag by the user; and cutting said net element between said reusable closure element and said second weld to provide a net bag.

2. A method for closing bags as in claim 1, comprising the further step of applying pressure to said closure element to force said closure element into and out of engagement with the bag to respectively close and open said bag.

* * * * *